US005153660A

United States Patent [19]

Goto

[11] Patent Number: 5,153,660

[45] Date of Patent: Oct. 6, 1992

[54] IMAGE FIXING ROTATABLE MEMBER AND IMAGE FIXING APPARATUS WITH SAME

[75] Inventor: Masahiro Goto, Kawasaki, Japan

[73] Assignee: Canon Kabushiki Kaisha, Tokyo, Japan

[21] Appl. No.: 714,352

[22] Filed: Jun. 12, 1991

Related U.S. Application Data

[63] Continuation of Ser. No. 228,051, Aug. 4, 1988, abandoned.

[30] Foreign Application Priority Data

Aug. 7, 1987 [JP] Japan ..... 62-196331

[51] Int. Cl.[5] ..... G03G 15/20; B21B 31/08; B21B 27/06

[52] U.S. Cl. ..... 355/285; 29/132; 219/469

[58] Field of Search ..... 355/290, 282, 285; 219/469; 29/132; 428/421, 422

[56] References Cited

U.S. PATENT DOCUMENTS

| | | | |
|---|---|---|---|
| 4,078,286 | 3/1978 | Takiguichi et al. | 29/132 |
| 4,198,739 | 4/1980 | Budinger et al. | 29/132 |
| 4,470,688 | 10/1984 | Inagaki et al. | 29/132 X |
| 4,522,866 | 7/1985 | Nishikawa et al. | 428/421 X |
| 4,763,158 | 8/1988 | Schlueter, Jr. | 355/290 X |
| 4,804,576 | 2/1989 | Kuge et al. | 29/132 X |
| 4,810,564 | 3/1989 | Takahashi et al. | 29/132 X |
| 4,842,944 | 6/1989 | Kuge et al. | 355/285 X |
| 4,883,715 | 11/1989 | Kuge et al. | 428/421 |
| 5,011,401 | 4/1991 | Sakurai et al. | 355/282 X |

FOREIGN PATENT DOCUMENTS

| | | | |
|---|---|---|---|
| 53-39134 | 4/1978 | Japan . | |
| 0086383 | 4/1987 | Japan | 355/290 |
| 0153984 | 7/1987 | Japan | 355/290 |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image fixing rotatable member includes an elastic layer into which inorganic filler material is mixed; a bonding layer on the elastic layer, containing resin material; and a resin layer applied and sintered on the bonding layer. The elastic layer below the bonding layer has a heat conductivity higher than that of the resin material in the bonding layer and contains an inorganic filler having a heat conductivity higher than that of the resin material used in the bonding layer. Because of these specific features of the bonding layer and the elastic layer, the resin in the bonding layer functions as a thermal barrier during the sintering of the resin and therefore the heat transmitted to the rubber layer is not accumulated but is effectively dissipated as a result of the high conductivity of the inorganic filler.

14 Claims, 2 Drawing Sheets

IMAGE FIXING ROTATABLE MEMBER AND IMAGE FIXING APPARATUS WITH SAME

This application is a continuation of application Ser. No. 228,051 filed Aug. 4, 1988 now abandoned.

FIELD OF THE INVENTION AND RELATED ART

The present invention relates to an image fixing rotatable member and an image fixing apparatus having the same, usable with an electrophotographic apparatus or the like to fix an unfixed image, more particularly to the image fixing rotatable member having an elastic layer and a resin layer.

It is conventional in the field of an electrophotographic copying machine that an unfixed image is formed on an image supporting member and is fixed by an image fixing apparatus. As for such an image fixing apparatus, a type wherein a rotatable member such as a roller or belts is used to fix by heat and/or pressure, is widely used.

U.S. Ser. Nos. 793,546, 831,729, 877,849 and 094,418 disclose an image fixing rotatable member having an elastic member and a resin applied and sintered thereon.

The image fixing rotatable member is excellent in the image fixing property, the parting property and wear resistance, and therefore, it is particularly effective in a high speed image fixing apparatus.

However, when the image fixing operation is repeated with this rotatable member, it has been found that the resin layer is partly peeled off the elastic layer although the surface resin layer itself and the elasticity of the elastic layer itself are still sufficient for image fixing operation. In addition, it has been found that it is rather difficult to select conditions such as temperature at the time of sintering, and if it is not proper, the elasticity of the elastic layer is deteriorated by the sintering heat.

SUMMARY OF THE INVENTION

Accordingly, it is a principal object of the present invention to provide an image fixing rotatable member and an image fixing apparatus having the same, in which the resin layer sticks more, and therefore, the durability is excellent.

It is another object of the present invention to provide an image fixing rotatable member and an image fixing apparatus using the same, in which the elastic layer is not deteriorated by the sintering heat when the resin is sintered.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
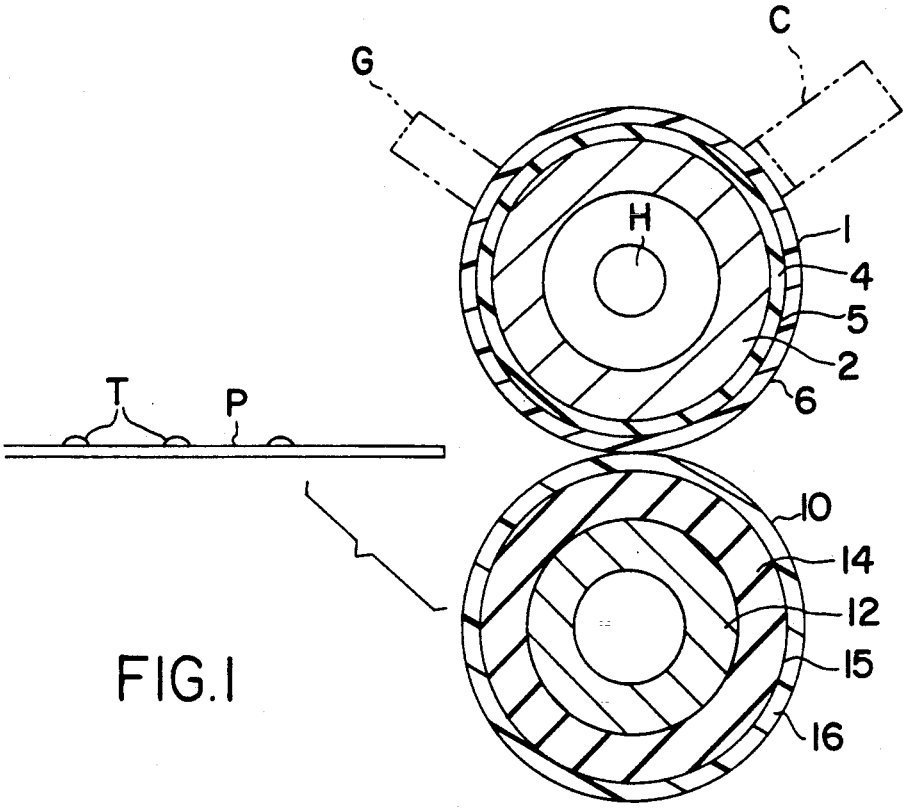
FIG. 1 is a sectional view of an image fixing apparatus according to an embodiment of the present invention.

The preferred embodiments of the present invention will be described in conjunction with the accompanying drawings wherein the elements having the corresponding functions are assigned the same reference numerals.

Figure 2:
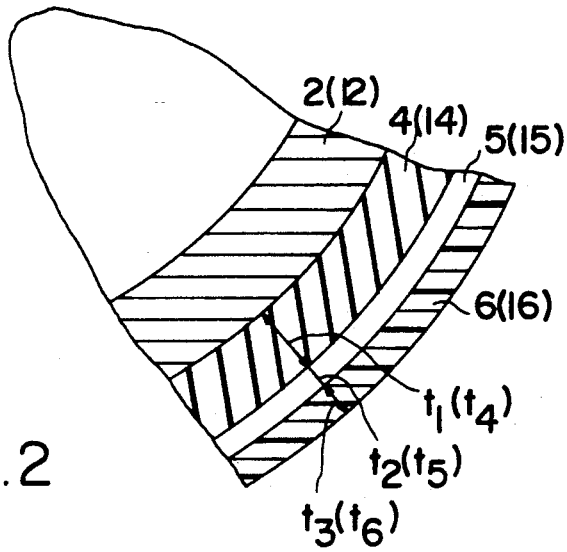
FIG. 2 is an enlarged view of a part of an image fixing rotatable member according to an embodiment of the present invention.

Referring to FIGS. 1 and 2, there is shown an image fixing apparatus and an image fixing rotatable member according to an embodiment of the present invention.

The image fixing apparatus comprises a heating roller 1 adapted to be contacted to an unfixed toner image T carried on the transfer sheets P having a heating source H therein and a back-up or pressing roller 10 press-contacted to the heating roller 1. The heating roller 1 and the pressing roller 10 have similar structures, and each comprises a core metal 2 or 12, an elastic layer 4 or 14, a bonding layer 5 or 15 and a resin layer 6 or 16.

The image fixing apparatus further comprises a temperature detecting and control means G for detecting the surface temperature of the heating roller 1 and for maintaining the surface temperature at an optimum toner-fusing temperature, for example, 160°-200° C., and an off-set preventing liquid applying means C for applying off-set preventing liquid such as silicone oil on the surface of the heating roller 1 and for cleaning the surface of the heating roller 1.

The core metal 2 of the heating roller 1 is made of a material having good thermal conductivity such as aluminum, and the elastic layer 4 is made of silicone rubber exhibiting good elastic property. The elastic layer 4 has, in this embodiment, a layer thickness $t_1$ of 0.3-0.8 mm (FIG. 2) and an impact resilience of 50-85%. The bonding layer is of a resin containing a heat durable resin such as polyamide, polyimide and epoxy resin and PFA (copolymer of tetrafluoroethylene resin and perfluoroalkoxyethylene resin), PTFA (tetrafluoroethylene resin) the mixture of the resin may contain and inorganic filler agent such as iron oxide. In this embodiment, the bonding layer 5 has a layer thickness $t_2$ of 1-7 microns (FIG. 2). The resin layer 6 is of fluorine resin such as PFA and PTFE exhibiting good parting or releasing properly. In this embodiment, the resin layer 6 has a layer thickness $t_3$ of 10-25 microns (FIG. 2), and the film strength is not less than 50 kg/cm$^2$.

On the other hand, the pressing roller 10 has a structure similar to the heating roller 1. The core metal 12 is made of stainless steel or iron. The thickness $t_4$ of the silicone rubber elastic layer 14 (FIG. 2) is larger than that of the heating roller, for example, 4-10 mm. The impact resilience thereof is 50-85%. The bonding layer 15, similarly to the heating roller 1, is made of a resin of a mixture of a heat durable resin such as polyamide, polyimide and epoxy resin and PFA or PTFE resin. The thickness of the bonding layer $t_5$ (FIG. 2) 1-7 microns. The resin layer 16 is, similarly to the resin layer of the heating roller 1, made of fluorine resin such as PFA and PTFE. The thickness $t_6$ (FIG. 2) thereof is 5-35 microns, and the film strength thereof is not less than 50 kg/cm$^2$. The pressing roller 10, as compared with the heating roller 1, deforms more at the nip than the heating roller, so that the bonding strength and the film strength thereof are required to be larger than those of the heating roller 1 to obtain the durability.

Each of the heating and pressing rollers 1 and 10 has a symmetricity about a center in the direction of the length thereof, and preferably, each of them has a reverse-crowned, by which the diameter in the central portion is slightly larger than those at the longitudinal end portions.

According to this embodiment, each of the heating roller 1 and the pressing roller 10 has the elastic layer 4 or 14, the bonding layer 5 or 15 and the resin layer 6 or 16. Silicone rubber is used for the elastic layer 4 or 14.

The silicone rubber layer contains an inorganic filler. When the surface of the elastic layer is polished during its manufacturing process, the inorganic filler is exposed at the surface thereof. The material of the inorganic filler mixed into the elastic layer is metal oxide such as aluminum oxide, titanium oxide, aluminum, quartz or the like. Those inorganic filler material has large surface energy so that the bonding strength between the filler material exposed to the surface of the elastic layer and the resin material in the bonding agent is strong, and therefore, the resin layer is not easily peeled off the elastic layer.

The bonding layer is of resin material, and therefore, the bonding strength thereof with the surface layer is very strong, and there is no problem in the bonding strength at the interface therebetween. Because the elastic layer contains the inorganic filler material exhibiting good thermal conductivity, and therefore, the elastic layer is more conductive thermally than the resin material in the bonding layer. The description will be made as to the prevention of the thermal deterioration of the elastic layer during the sintering of the resin layer.

During production of the roller, heat is applied externally to heat and sinter the resin layer. However, even if it is rapidly heated, the heat is not accumulated in the elastic layer since it has the good thermal conductivity as described above, and the heat is transferred quickly to the core metal. The same applies in the cooling operation, and the heat in the elastic layer is quickly escaped. Thus, the elastic layer itself has a structure which is not easily thermally deteriorated. On the other hand, the resin material contained in the bonding layer is on the surface of the elastic layer as a bonding agent, and the thermal conductivity of the resin material is not good, and therefore is effective to confine the thermal flow from the outside of the roller to the elastic layer, thus minimizing the heat introduction from the outside into the elastic layer. In this embodiment, the elastic layer has a thermal conductivity of $1.5\times10^{-3}$ cal.cm/sec.cm$^2$.° C., and the polyamide resin in the bonding layer has a thermal conductivity of $0.5\times10^{-3}$ cal.cm/sec.cm$^2$.° C.

Because of the existence of the bonding layer having a thermal conductivity lower than that of the elastic layer, the problem of the thermal deterioration of the elastic layer at the time of sintering the resin layer can be solved with more certainty.

Results of experiment using this embodiment will be described. The surface temperature of the heating roller 1 was maintained at 180° C. The image fixing operation was continued, and A4 size (JIS) sheets were processed at a speed of 200 m/sec, 30 sheets/min. When the ambient temperature was 15° C., good image fixing properties were shown, and the production of the toner offset was reduced to not more than one fifth the conventional good image fixing apparatus. The usable period of the cleaning member was elongated to not less than 5 times. When the room temperature was 32.5° C., and the humidity was 85%, the transfer sheets were not buckled, and they were properly stacked on a sorter or the like. The images were not collapsed, and the quality thereof was high. Those were maintained even after 300,000 sheets were fixed. Even after 500,000 sheets were fixed, the parting property, and the fixing power were not decreased, and the peeling between the layers was not observed.

The description will be made as to the inorganic filler material used in this embodiment. Various experiments carried out by the inventor has revealed that the aluminum oxide, titanium oxide, iron oxide or quartz are good in providing both of good thermal conductivity of the elastic layer and high bonding strength with the bonding layer. Particularly, if the particle size of the filler material is 0.5–30 microns, high bonding strength can be provided. The thermal conductivity of the elastic layer is preferably not less than $0.8\text{–}10^{-3}$ cal.cm/sec.cm$^2$.° C., and the material of the bonding layer is preferably polyamide, polyimide or epoxy resin. The thermal conductivity thereof is preferably not more than $0.6\times10^{-3}$ cal.cm/sec.cm$^2$.° C.

The description will be made as to preferable method of manufacturing the fixing rollers.

As for the heating roller 1, an aluminum core metal 2 is prepared which has been finished such that the outer diameter at the central portion is 58.3 mm with an amount of the reverse-crown of 150 microns, and the thickness thereof is 0.5 mm. The surface thereof is sandblasted to be degreased and then is dried. The core metal 2 is coated with a primer and then is wrapped with a vulcanizable type silicone rubber sheet into which aluminum oxide is added as the inorganic filler to provide good thermal conductivity (the thermal conductivity is $1.5\times10^{-3}$ cal.cm/sec.cm$^2$.° C. It is press-vulcanized for 30 min at 160° C. and thereafter, it was machined to the rubber thickness of 0.5 mm, by which a silicone rubber roller is produced. The silicone rubber layer thus produced is coated with mixed polyamide resin and PTFE resin dispersed in the solvent by spray to a thickness of 3 microns to form a bonding layer. The bonding layer is air dried at the room temperature. Then, it is further coated with PTFE dispersion in a thickness of 20 microns by spray. The core metal is masked by a thermally insulative member, and the PTFE surface layer is quickly heated for 15 minutes at 380° C., while the inside of the core metal is air cooled. By sintering the PTFE coating in this manner, and thereafter it is quickly cooled. By the sintering, a sintered fluorine resin surface layer having a crystallinity of not less than 95%, a tensile strength of not less than 50 kg/cm$^2$ and a contact angle with respect to water is not less than 100 degrees, is formed on the silicone rubber roller with a high strength to the rubber roller and with a sufficient thickness.

The pressing roller 10 can be produced in the manner similar to that for the heating roller 1. The core metal 12 is made of iron, the same materials are used for the elastic layer 14, the bonding layer 15 and the resin layer 16. However, the layer thickness of the elastic layer 14 is 6 mm, the layer thickness of the bonding layer 15 is 6 microns, and that of the resin layer is 25 microns. The outside diameter of the roller is the same as the heating roller. It is important in the manufacture of the elastic rotatable member that when the resin layer is sintered after the resin layer not sintered is applied on the elastic layer, the temperature of the elastic layer is maintained lower than the heat durable temperature of the material constituting the elastic layer.

The sintering of the fluorine resin layer of the heating roller 1 and the pressing roller 10 can be properly carried out using dielectric heating.

Figure 3:
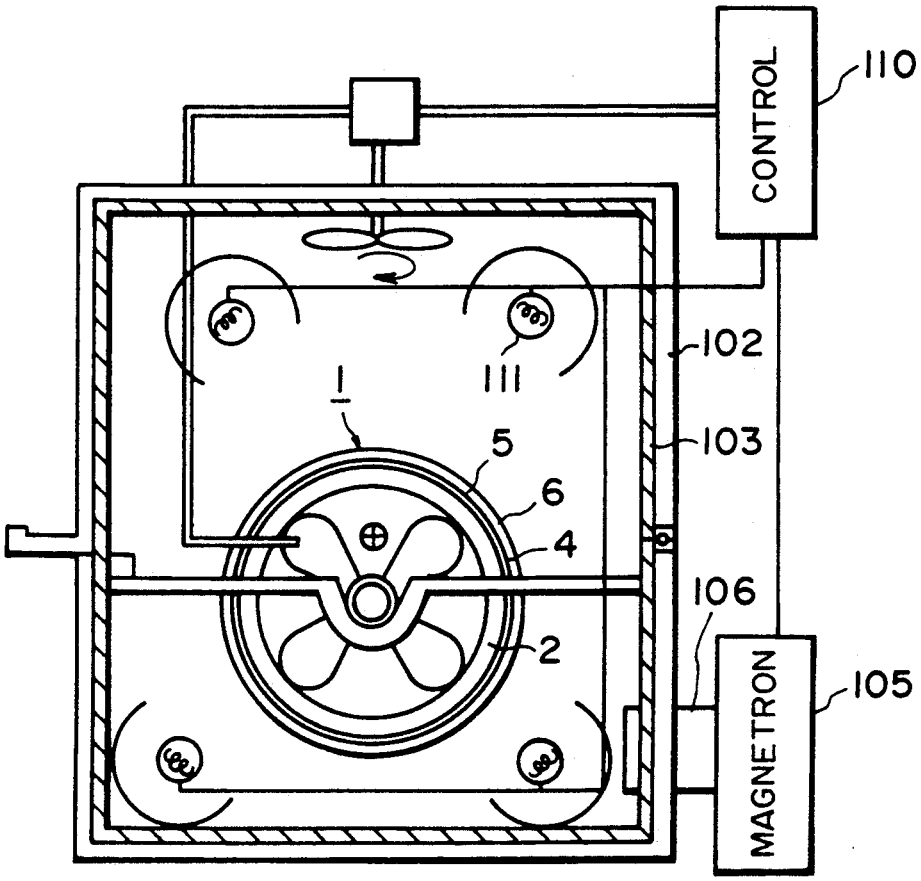
FIG. 3 is a sectional view of an apparatus for manufacturing the image fixing roller according to the embodiments of the present invention.

Referring to FIG. 3, there is shown an example of a dielectric heating apparatus which is suitably used with the present invention. In this system, both of the dielectric heating and an external infrared heating are employed. The apparatus comprises a magnetron 105, a waveguide 106 for guiding a high frequency wave (950 MHz–2450 MHz) produced by the magnetron 105, an openable resin container 102 connected to the waveguide 106 and having a high frequency wave reflecting plate 103 of a metal on the inside thereof and upper and lower infrared lamp 111 with shade for externally heating with infrared rays. The magnetron 105 and the infrared lamp 111 are controlled by control means 110.

In this Figure, the heating roller 1 is shown as an example. Since the heating roller 1 includes the silicone rubber layer 4, 5 in the inside and a fluorine resin coating layer 6 on the surface, the high frequency energy is absorbed more by the fluorine resin coating layer 6 since it has a larger dielectric constant than the silicone rubber layer 4. Therefore, the fluorine resin layer 6 is quickly heated in the constant temperature container by the high frequency wave and the infrared rays, and is completely sintered by the heating for 15 minutes to 340° C. After the sintering, the roller is quickly cooled. Suitable surface fluorine resin material is PTFE dispersion available from Daikin Kabushiki Kaisha (tetrafluoroethylene resin dispersion D-1). The pressing roller 10 is sintered in the same manner.

By using the dielectric heating in this manner, the energy loss can be reduced, and the heat flow into the lower elastic layer can be minimized. The fixing roller 1 and the heating roller 10 produced in the above-described manner using the dielectric heating had rubber properties of the elastic layer 4, 14 which were generally the same as those had by the rubber before the sintering (impact resilience or the like). The surface fluorine resin layer (PFA or PTFE layer 6, 16) was completely sintered to show good releasing property, resistance to wear and bonding property with the elastic layer.

In this embodiment, the rotatable member according to the embodiments were used for both of the heating and pressing roller, but the present invention may be used only for one of them. However, since the rotatable member according to the embodiments are excellent in the thermal properties, and therefore, it is particularly effective if the present invention is used at least in the heating roller.

While the invention has been described with reference to the structures disclosed herein, it is not confined to the details set forth and this application is intended to cover such modifications or changes as may come within the purposes of the improvements or the scope of the following claims.

What is claimed is:

1. An image fixing rotatable member, comprising:

an elastic rubber layer;

a bonding layer on the elastic layer; and a resin layer applied and sintered on the bonding layer, wherein said bonding layer contains resin material having a thermal conductivity of no greater than $0.6\times10^{-3}$ cal.cm/sec.cm$^2$.° C., said elastic rubber layer contains inorganic filler having a heat-conductivity higher than that of the resin material in said bonding layer and said elastic rubber layer has a heat conductivity higher than that of the resin material in said bonding layer.

2. A member according to claim 1, wherein the filler material is exposed at a surface of the elastic layer.

3. A member according to claim 1, wherein said elastic layer is of silicone rubber, and the resin material of said bonding layer and said resin layer are of fluorine resin.

4. A member according to claim 1, further comprising a metal core as a base layer.

5. A member according to claim 1, further comprising an inside heating source.

6. A member according to claim 1, wherein the inorganic filler is of metal oxide or quartz.

7. A image fixing apparatus, comprising:

a couple of rotatable members for fixing an unfixed image, at least one of said rotatable members including:

an elastic rubber layer into which inorganic filler material is added;

a bonding layer on said elastic layer; and a resin layer applied and sintered on said bonding layer, wherein said bonding layer contains resin material having a thermal conductivity no greater than $0.6\times10^{-3}$ cal.cm/sec.cm$^2$.° C., said elastic rubber layer contains inorganic filler having a heat-conductivity higher than that of the resin material in said bonding layer and said elastic rubber layer has a heat conductivity higher than that of the resin material in said bonding layer.

8. An apparatus according to claim 7, wherein said at least one of the rotatable members is adapted to be contacted to an unfixed image and is heated by a heating source.

9. An apparatus according to claim 7, wherein the filler material is exposed at a surface of the elastic layer.

10. An apparatus according to claim 7, wherein said elastic layer is of silicone rubber, and the resin material of said bonding layer and said resin layer are of fluorine resin.

11. An apparatus according to claim 7, further comprising a metal core as a base layer.

12. An apparatus according to claim 7, further comprising an inside heating source.

13. An apparatus according to claim 7, wherein the inorganic filler material is of metal oxide or quartz.

14. An apparatus according to claim 7, wherein said elastic rubber layer has a thickness of 0.3–0.8 mm; said bonding layer has a thickness of 1–7 microns; and said resin layer has a thickness of 10–25 microns.

* * * * *

UNITED STATES PATENT AND TRADEMARK OFFICE

CERTIFICATE OF CORRECTION

PATENT NO. : 5,153,660

DATED : October 6, 1992

INVENTOR(S) : MASAHIRO GOTO

It is certified that error appears in the above-identified patent and that said Letters Patent is hereby corrected as shown below:

On title page, item

[56] REFERENCES CITED

"4,470,688 10/1984 Inagaki et al.
4,522,866 7/1985 Nishikawa et al" should read.
--4,470,688 9/1984 Inagaki et al.
4,522,866 6/1985 Nishikawa et al--.

COLUMN 2

Line 39, "and" should read --an--.
Line 55, "$T_5$(FIG.2)" should read --$t_5$(FIG.2) is--.

COLUMN 4

Line 21, "to" should read --to a--.

COLUMN 6

Line 24, "A" should read --An--.

Signed and Sealed this

Twenty-sixth Day of October, 1993

Attest:

Bruce Lehman

BRUCE LEHMAN

Attesting Officer

Commissioner of Patents and Trademarks